US007024127B2

(12) United States Patent
Hisakuni

(10) Patent No.: US 7,024,127 B2
(45) Date of Patent: Apr. 4, 2006

(54) IMAGE FORMING APPARATUS INCLUDING A CLEANING MEMBER FEATURING A CHANGEABLE ABUTTING PRESSURE

(75) Inventor: Hisataka Hisakuni, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/921,999

(22) Filed: Aug. 20, 2004

(65) Prior Publication Data

US 2005/0013624 A1 Jan. 20, 2005

Related U.S. Application Data

(62) Division of application No. 10/377,758, filed on Mar. 4, 2003.

(30) Foreign Application Priority Data

Mar. 22, 2002 (JP) ..... 2002-081028
Jan. 31, 2003 (JP) ..... 2003-023818

(51) Int. Cl.
*G03G 21/00* (2006.01)

(52) U.S. Cl. ..... 399/71; 399/350

(58) Field of Classification Search ..... 399/71, 399/350, 351; 15/256.5, 256.51
See application file for complete search history.

(56) References Cited

U.S. PATENT DOCUMENTS

| | | | | |
|---|---|---|---|---|
| 4,465,362 | A | 8/1984 | Tohma et al. | 15/256.51 |
| 4,702,591 | A | 10/1987 | Tsuda et al. | 399/350 |
| 4,875,081 | A | 10/1989 | Goffe et al. | 399/350 |
| 5,278,620 | A | 1/1994 | Godlove | 399/71 |
| 5,500,723 | A | 3/1996 | Godlove | 399/350 |
| 6,029,025 | A | 2/2000 | Sakakibara et al. | 399/71 |

FOREIGN PATENT DOCUMENTS

| | | |
|---|---|---|
| JP | 3-284785 | 12/1991 |
| JP | 5-154379 | 7/1993 |
| JP | 7-210058 | 8/1994 |

*Primary Examiner*—William J. Royer
(74) *Attorney, Agent, or Firm*—Fitzpatrick, Cella, Harper & Scinto

(57) ABSTRACT

An image forming apparatus includes an image forming unit for forming a developer image on a first image bearing member, a transferring unit for transferring the developer image on the first image bearing member onto a second image bearing member, a cleaning member abutted against the first image bearing member, and an abutting pressure changing device for changing the pressure under which the cleaning member is abutted against the first image bearing member, wherein control is carried out such that the abutting pressure in a second operation in which a developer image on the first image bearing member that is not transferred onto the second image bearing member is removed is higher than the abutting pressure in a first operation in which a developer remaining on the first image bearing member is removed after the developer image is transferred onto the second image bearing member.

2 Claims, 6 Drawing Sheets

IMAGE FORMING APPARATUS INCLUDING A CLEANING MEMBER FEATURING A CHANGEABLE ABUTTING PRESSURE

CROSS-REFERENCE TO RELATED APPLICATION

This application is a divisional application of application Ser. No. 10/377,758, filed Mar. 4, 2003.

BACKGROUND OF THE INVENTION

1. Field of the Invention

The present invention relates to an image forming apparatus, such as an electrostatic copying machine or an electrostatic printer, that uses an electrophotographic process.

2. Description of the Related Art

Recently, a compound machine that combines all output terminals, including a copier, a printer and a facsimile has come to be extensively accepted in the market. Image forming apparatuses using the electrophotographic process are finding extensive use as network-compatible output terminals.

One of the big disadvantages of such a compound machine is the duty cycle of the main unit thereof. The duty cycle means the critical number of sheets for which the main unit continues to normally operate without the need for maintenance by a serviceperson. One of the significant challenges in improving the duty cycle is an extended service life of an image bearing member. Other significant challenges to be addressed include minimizing waste, that is, reducing consumables, extending the service lives of consumables, and achieving higher reliability from the viewpoint of ecology.

With the increasing trend toward replacing conventional analog apparatuses by digital apparatuses, reducing the cost of main units to the same as or less than that of analog apparatuses has also become a challenge.

Furthermore, the conventional mainstream of monochrome models of copiers and printers is rapidly being replaced by full-color models for producing full-color documents or output files at offices. In addition to achieving the same cost as that of the main units of analog machines also for digital machines, achieving the same running cost as that of monochrome printing for producing full-color prints is also becoming a task to be performed. The challenges require technologies that make it possible to dramatically lower TCO, which means the total cost of ownership (TCO).

Regarding an image forming apparatus employing an electrophotographic process technology, fabricating a full-color printer by using an engine of substantially the same cost as that of a monochrome printer may be accomplished by utilizing a technique for superimposing images in four colors on an intermediate transferrer by a single photosensitive member. Moreover, running the intermediate transferrer by belt permits greater freedom of the layout of the components in the printer main unit, with a consequent reduction in size. In this construction, which involves repeated use of the intermediate transferrer to superimpose images on the intermediate transferrer, it is necessary to remove a remaining toner. For this purpose, a method has been used in which an edge of a cleaning blade formed of an elastic material, such as rubber, is applied to an intermediate transferrer to remove the toner residues therefrom.

A known cleaning apparatus is disposed near a belt-like intermediate transferrer and includes a photosensitive member and a secondary transfer roller disposed therearound.

The cleaning apparatus includes a casing having an opening facing the intermediate transferrer. An end of a cleaning blade formed of urethane rubber or the like is attached at the opening, and an edge of the cleaning blade is abutted against the intermediate transferrer in the direction opposite from a direction in which the intermediate transferrer is driven. When a toner remaining from a secondary transferring portion (not shown) reaches the edge of the cleaning blade, the residual toner is scraped off.

A small quantity of the transfer residual toner that has been scraped off by the cleaning blade is supplied to the edge of the cleaning blade as the intermediate transferrer is rotated. This causes a drop in the frictional force due to the presence of the toner powder, and the chance of the cleaning blade being turned up can be minimized, thus permitting stable, satisfactory cleaning performance to be achieved. The cleaning blade is set to ensure good toner removing performance as well as minimized chance of the cleaning blade being turned up, by selecting optimum values for, e.g., the thickness of the rubber component used for the cleaning blade, the length of the rubber tip (free length) and the abutting pressure.

In the apparatus described above, however, it is difficult to continue preventing the cleaning blade from being turned up after prolonged contact between the cleaning blade and the intermediate transferrer against which the cleaning blade is abutted. Although the edge portion of the cleaning blade is lubricated by the toner supplied, the quantity of the transfer residual toner that is supplied does not remain stable, depending on an operating condition. For this reason, it has been required to properly select the quantity of toner to prevent undue friction between the cleaning blade and the intermediate transferrer against which the cleaning blade is applied.

Hitherto, the abutting pressure of a cleaning blade has been set at a slightly high level so as to ensure adequate cleaning even with a maximum quantity of a toner on an object to be cleaned. Examples in which the quantity of a toner increases include a case where a paper jam or the like interrupts an image forming cycle, leaving a toner for an untransferred image, especially a solid image, on a photosensitive drum or the intermediate transferrer. Particularly in the case of an intermediate transferrer for superimposing images of a plurality of colors, the quantity of a remaining toner increases. In other words, in a normal image forming operation, the quantity of a transfer residual toner is small because the toner is transferred to a transfer member, thus requiring a lower pressure to remove the residual toner. The abutting pressure is set to a high level in order to successfully cope with abnormal situations. Such a high pressure set for the cleaning blade has been a cause of a high possibility of damages, such as turning up of the cleaning blade, an increased wear on a photosensitive drum and an intermediate transferrer, or an increased torque of the apparatus.

Thus, it has been difficult to achieve both satisfactory cleaning performance for a maximum quantity of toner and prolonged stability of the cleaning performance at the same time.

In recent years, with an extended service life of abutted members, such as a photosensitive member, it is becoming difficult to maintain the restraint of the turning up of the cleaning blade merely by properly selecting initial values until the service life of an abutted member expires. As a solution to this problem, there has been proposed a construction that enables the abutting conditions of the cleaning blade to be changed by providing a device for detecting the load to be applied to the cleaning blade (Japanese Unexamined Patent Application Publication No. 5-165379). This construction, however, is complicated, inevitably resulting in a large size of the apparatus.

Various other constructions using electroconductive rubber agent to achieve higher functionality of the cleaning blade have been also proposed (e.g., Japanese Unexamined Patent Application Publication No. 3-284785). These constructions have been proposed to obtain the functions for de-electrifying or electrifying an electrostatic latent image bearing member and/or to de-electrify a toner to permit easier removal of the toner.

Japanese Unexamined Patent Application Publication No. 7-210058 discloses a construction in which a bias is applied to an electroconductive cleaning blade to attract a toner to a nipping portion thereby to achieve improved cleaning performance.

None of these conventional examples, however, have achieved both satisfactory cleaning performance for successfully coping with a maximum quantity of toner and stable cleaning performance for an extended period of time.

SUMMARY OF THE INVENTION

It is an object of the present invention to provide an image forming apparatus having a longer service life thereof, while securing cleaning performance at the same time.

To this end, the present invention provides an image forming apparatus including:

- an image forming device for forming a developer image on a first image bearing member;
- a transferring device for transferring the developer image on the first image bearing member onto a second image bearing member;
- a cleaning device having a cleaning member abutted against the first image bearing member;
- an abutting pressure changing device for changing the pressure under which the cleaning member is abutted against the first image bearing member; and
- a controller for controlling the abutting pressure changing device such that the abutting pressure in a second operation in which a developer image on the first image bearing member that is not transferred onto the second image bearing member is removed is higher than the abutting pressure in a first operation in which a developer remaining on the first image bearing member is removed after the developer image is transferred onto the second image bearing member.

Further objects, features and advantages of the present invention will become apparent from the following description of the preferred embodiments (with reference to the attached drawings).

DESCRIPTION OF THE PREFERRED EMBODIMENTS

An embodiment in accordance with the present invention will be described in conjunction with the accompanying drawings.

Figure 1:
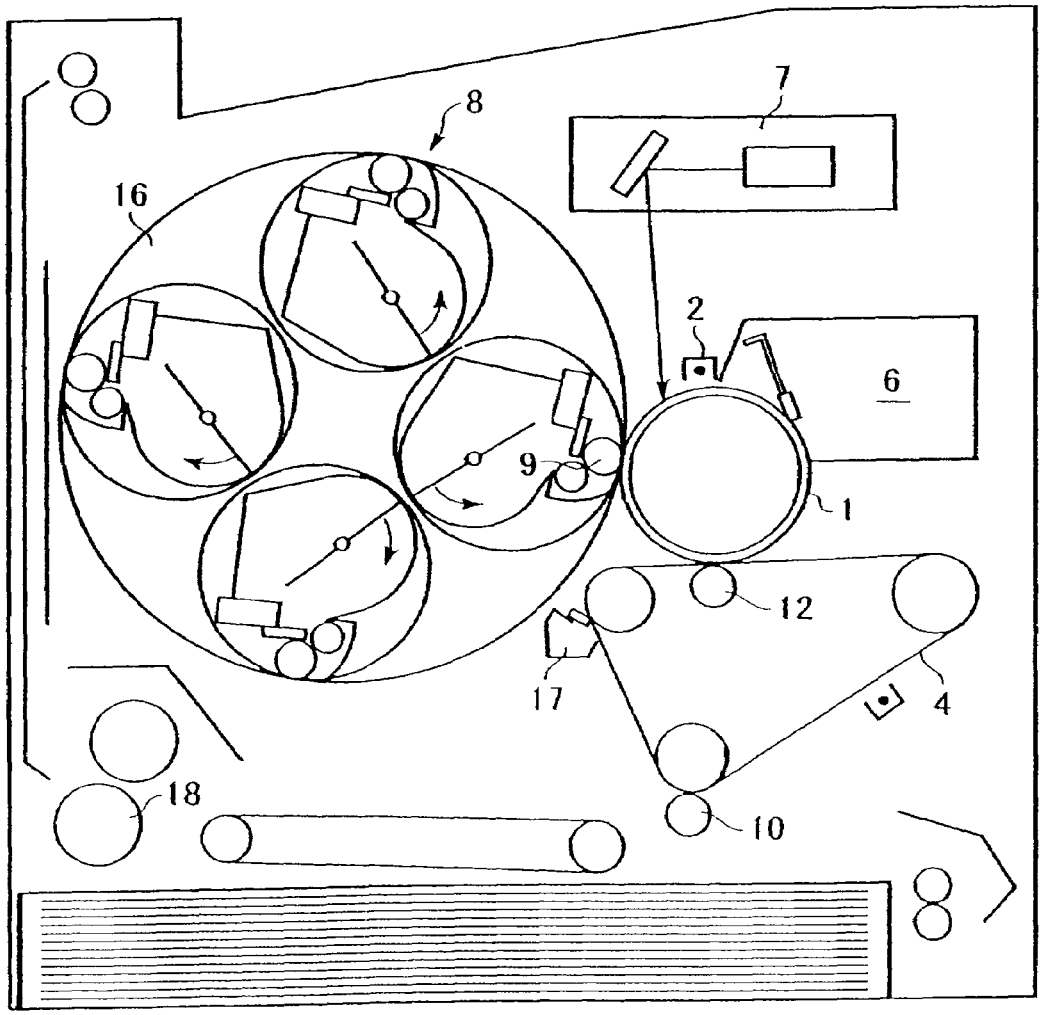
FIG. 1 is a schematic block diagram of an image forming apparatus according to an embodiment of the present invention.
Figure 2:
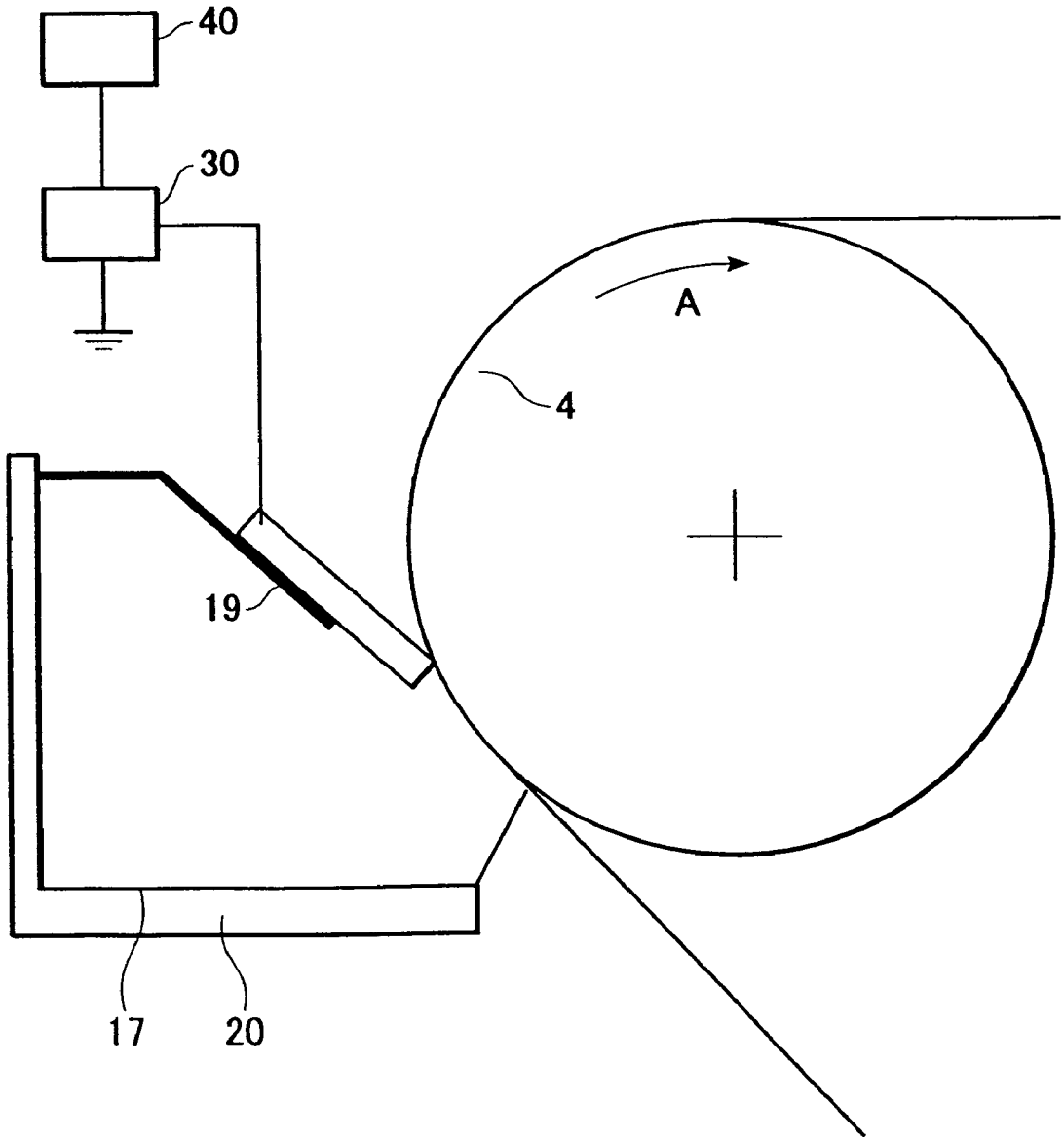
FIG. 2 is a side sectional view of a cleaning apparatus according to the embodiment.

FIG. 1 is a schematic sectional view of an image forming apparatus according to the present invention, and FIG. 2 is a side sectional view of a cleaning device according to the embodiment.

(Image Forming Apparatus)

The image forming apparatus shown in FIG. 1 is an electrophotographic copying machine adapted to form an image on a recording medium in response to image signals sent from a computer or the like (not shown). A photosensitive member 1 of the image forming apparatus is uniformly charged by a charging device 2, then a laser oscillator 7 radiates a laser beam onto the photosensitive member 1 on the basis of an image signal, which may be a pattern signal. An electrostatic latent image is formed on a portion on the photosensitive member 1 to which the laser beam has been radiated, and the electrostatic latent image is formed into a visible image with a toner, which is a developer, by a developing unit 8. An intermediate transferrer 4 is pushed against the photosensitive member 1 by a primary transfer roller 12. The toner image visibly formed on the photosensitive member 1 is transferred by applying a transfer voltage to the primary transfer roller 12.

To form a full color image, the color developed by the rotation of a developing rotary 16 is changed, then a toner image of a second color that has been formed into a visible image on the photosensitive member 1 in the same manner is superimposably transferred onto the intermediate transferrer 4. In the same manner, the images of the four colors are transferred onto the intermediate transferrer 4, then a sheet of paper, which is a recording medium, is fed from a cassette to a secondary transfer roller 10 to transfer the four-color toner image at the same time. The toner image transferred onto the sheet of paper is subjected to heat and pressure by a fixing unit 18 so as to be fixed. Thereafter, the toner remaining on the photosensitive member 1 and the intermediate transferrer 4 is removed by a photosensitive member cleaning unit 6 and an intermediate transferrer cleaning unit 17, respectively, to be ready for the next image forming cycle.

The photosensitive member 1 used in the embodiment is an organic photoconductor (OPC) photosensitive member formed of a charge generating layer using a titanyl-phthalocyanine pigment and a charge transport layer using a bisphenol Z type polycarbonate as a binder. Alternatively, however, the photosensitive member 1 may be an A-Si photosensitive member or a Se photosensitive member.

The toner used in the embodiment is formed by the suspension polymerization process including an ester-based wax for a core, a styrene-butyl acrylate for a resin layer, and a styrene polyester for a surface layer. The polymerized toner is prepared such that the form factor of the toner is as follows: the value of SF-1 is $100 \leqq SF\text{-}1 \leqq 140$ and the value of SF-2 is $100 \leqq SF\text{-}2 \leqq 120$. A compound of the polymerized toner and a resin magnetic carrier prepared by a polymerization method has been used as a binary developer.

The intermediate transferrer 4 used in the embodiment is formed by depositing a coating of an insulating acrylic resin having a volume resistivity of $10^{14}$ Ωcm or more to a thickness of 2 μm on the surface of a 100 μm-thick polyimide resin sheet having a volume resistivity of about $10^9$ Ωcm to about $10^{10}$ Ωcm.

Referring to FIG. 2, the cleaning unit 17 is provided with a casing 20 that has an opening adjacent to the intermediate transferrer 4. A cleaning blade 19 is installed at the opening by a support member. One edge of the cleaning blade 19 is in contact with the intermediate transferrer 4. When a residual toner left over from the secondary transfer roller 10 reaches the edge of the cleaning blade 19, the residual toner is scraped off by the edge. A receiving sheet is installed on the bottom of the casing 20 to guide the toner that has been scraped off into the casing 20 and to restrain the toner from moving back to the intermediate transferrer 4.

A conveying device for discharging a residual toner is disposed in the casing 20 to carry the residual toner that has fallen into the casing 20 in the direction perpendicular to the drawing thereby to discharge the toner out of the cleaning unit 17. This construction prevents the casing 20 from being clogged with residual toner.

The cleaning blade 19 in the embodiment uses polyurethane rubber having carbon particles scattered therein. When the intermediate transferrer 4, which is the member against which the cleaning blade 19 is abutted, is actually driven, the cleaning blade 19 tends to bite in the intermediate transferrer 4 due to the frictional force produced therebetween, resulting in an increase in the virtual abutting pressure.

The cleaning blade 19 is formed of a thermosetting polyurethane resin because of its high resistance to wear and plastic deformation. The electroconductive polyurethane rubber in the embodiment is obtained by adding a cross-linker and electroconductive particulates to a pre-polymer formed of a macromolecular polyol and polyisocyanate, then by subjecting the mixture to heat curing. Carbon black has been used as the electroconductive particulates in the embodiment. The resistivity of the electroconductive polyurethane rubber thus obtained is $10^7$ Ω/cm and the rubber hardness thereof is JISA 70 degrees.

The resistance of the cleaning blade 19 preferably ranges from $10^5$ Ωcm to $10^{11}$ Ωcm in terms of volume resistivity. If the volume resistivity is below $10^5$ Ωcm, a leakage problem tends to arise when a bias is applied. On the other hand, if the volume resistivity exceeds $10^{11}$ Ωcm, then it is difficult to supply sufficient electric charges for increasing the force for abutting the cleaning blade 19.

The abutting pressure can be increased by increasing the amount of applied current when supplying current to the cleaning blade 19 from a high-voltage power source 30. The high-voltage power source 30 is controlled by a controller 40.

When a voltage is applied to an electroconductive cleaning blade, electric charges based on the potential difference between the cleaning blade and the surface of the object to be cleaned are generated. The electric charges cause the electroconductive cleaning blade and the object to be cleaned to be drawn toward each other. The cleaning blade and the object to be cleaned slide to move, so that the force of attraction between the cleaning blade and the object to be cleaned depends upon the amount of current for producing electric charges. For this reason, it is preferred to carry out constant-current control in order to ensure stable application of a desired pressure to the cleaning blade by applying a bias.

Preferably, the object to be cleaned against which the cleaning blade is abutted has a large capacitance to obtain a high blade abutting pressure based on electrostatic adhesion. For instance, in an intermediate transferrer, an insulating layer provided on the surface makes it easier to store electric charges, and making the insulating layer thin restrains adverse influences on transfer. Capacitance-wise, the same applies to a photosensitive drum. Hence, an A-Si photosensitive member providing a larger capacitance is more advantageous than an OPC photosensitive member in obtaining a larger force for attracting a cleaning blade.

Figure 3:
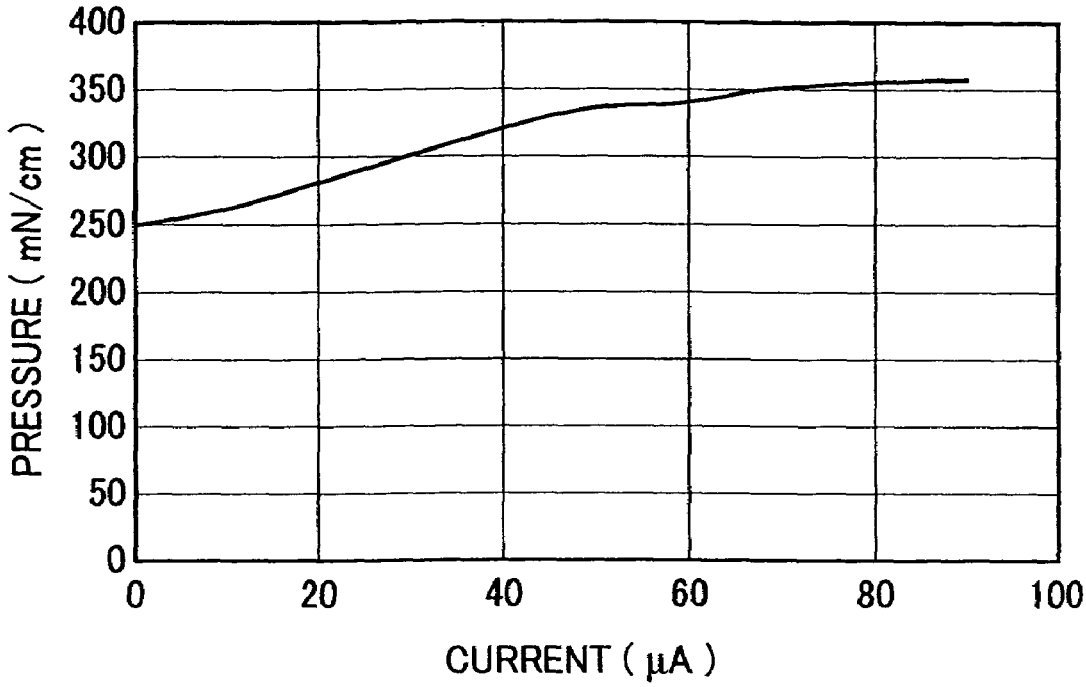
FIG. 3 shows measurement results of abutting pressure versus amount of current supplied.

FIG. 3 shows the measurement results of the abutting pressure and the amount of current supplied that are observed when actual slide friction occurs. For the measurement, the pressure applied by a spring per unit length of the cleaning blade 19 abutted against the intermediate transferrer 4 was set to 250 mN/cm. The angle of the cleaning blade 19 (the angle being formed by the tangent at the cleaning blade 19 abutting portion and the blade) was set to 25 degrees.

The abutting pressure of the cleaning blade 19 must be set at least to a value that permits the removal of a maximum quantity of toner in actual operation. As an example of the need for removing a maximum quantity of toner, there is a case where an image forming cycle is interrupted due to a trouble, such as jamming, which takes place while conveying a transfer material, and the toners of four colors left on the intermediate transferrer 4 must be removed after the jamming of the apparatus is cleared. For this purpose, a blade abutting pressure of 350 mN/cm or more is required in actual operation.

On the other hand, however, if the abutting pressure of the cleaning blade 19 is increased so as to ensure thorough cleaning even when a failure, such as jamming, takes place, then the problem of the cleaning blade 19 being turned up may occur if an insufficient quantity of toner, which serves as a lubricant, is supplied to the cleaning blade 19 when normal image formation is performed in, for example, a hot and humid environment.

Furthermore, since a high abutting pressure is always maintained, the driving torque of the entire apparatus is accordingly high, and the wear on the cleaning blade 19 and the intermediate transferrer 4 is accelerated, resulting in shortened service lives.

To solve the aforesaid problem, the cleaning is performed only under a set abutting pressure applied to the cleaning blade 19 without applying a voltage to the cleaning blade 19 in a normal image formation operation, while a voltage is applied to the cleaning blade 19 to increase the pressure applied to the cleaning blade 19 only after a resetting operation for clearing a failure, such as jamming, is performed.

A supplementary description will be given of the resetting operation. If jamming or other failure is detected, the image forming apparatus brings an image forming operation cycle to an emergency stop. When a user of the apparatus clears the jamming or the like, then the image forming apparatus resets itself to be ready for restarting the image forming operation. In the resetting procedure, the transfer residual toner remaining on the photosensitive drum 1 or the intermediate transferrer 4 is removed by the cleaning blade 19.

Thus, the virtual abutting pressure of the cleaning blade 19 can be reduced, and the cleaning blade 19 can be prevented from being turned up. This makes it possible to maintain good cleaning performance.

A copying machine altered to have the construction described above (trade name being NP4050 made by CANON KABUSHIKI KAISHA) has been used to evaluate the cleaning performance after processing 100,000 sheets of paper.

Figure 4:
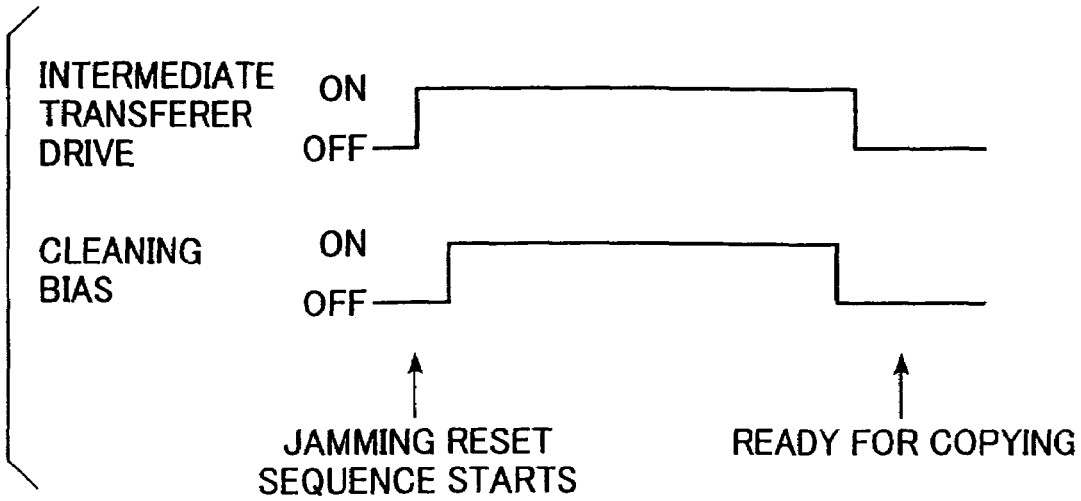
FIG. 4 is a timing chart of the application of a bias in the embodiment.

In order to intentionally cause failures to take place, jamming has been forcibly caused to happen during the test image forming operation once every 1,000 sheets of paper. The sequence for resetting the copying machine after paper jamming takes place is shown by the timing chart in FIG. 4. In this embodiment, after paper jamming occurred and the user cleared the paper jamming, the toner remaining on an intermediate transferrer was removed by a cleaning device before the apparatus was reset to be ready for copying again. During the resetting operation, a predetermined current (e.g., 80 μA) was applied to a cleaning blade to increase the blade abutting pressure while the intermediate transferrer was being driven.

The durability test was conducted by applying the conventionally set abutting pressure of 350 mN/cm by a spring, which is used when the toners of four colors fail to be transferred onto a transfer material. In this case, the cleaning blade tended to be turned up. The edge portion of the cleaning blade was damaged when the 100,000 sheets of paper was processed.

In contrast to the above setting, another durability test was conducted using the embodiment. For this test, the abutting pressure applied by a spring was set to 250 mN/cm, and the current of 80 μA was supplied to the cleaning blade 19 only when the failure happened. After the 100,000 sheets of paper were processed, no damage was observed on the edge portion of the cleaning blade 19, and the cleaning performance remained satisfactory.

In this embodiment, the construction in which the bias is applied to the cleaning blade in the resetting sequence after paper jamming takes place. Alternatively, however, a toner pattern may be formed on an intermediate transferrer or a photosensitive member in order to adjust the density of images, and a bias may be applied to the cleaning blade when cleaning the toner pattern, during which the density thereof is measured. Most toner patterns use images of a high density and are not transferred onto other members, so that they carry a larger quantity of toner than the quantity of toner left over from transfer in a normal image formation mode. In order to thoroughly remove the toners, therefore, a higher blade pressure than that in the normal image formation mode is required. Thus, in the normal image formation mode, no bias is applied to the cleaning blade in the normal image formation mode, while the bias is applied only when the formed toner pattern is cleaned.

(Another Embodiment)

In the foregoing embodiment, the construction has been described in which the bias is applied to the cleaning blade 19 abutted against the intermediate transferrer 4. The construction can be applied also for cleaning a photosensitive drum in the same manner.

Figure 5:
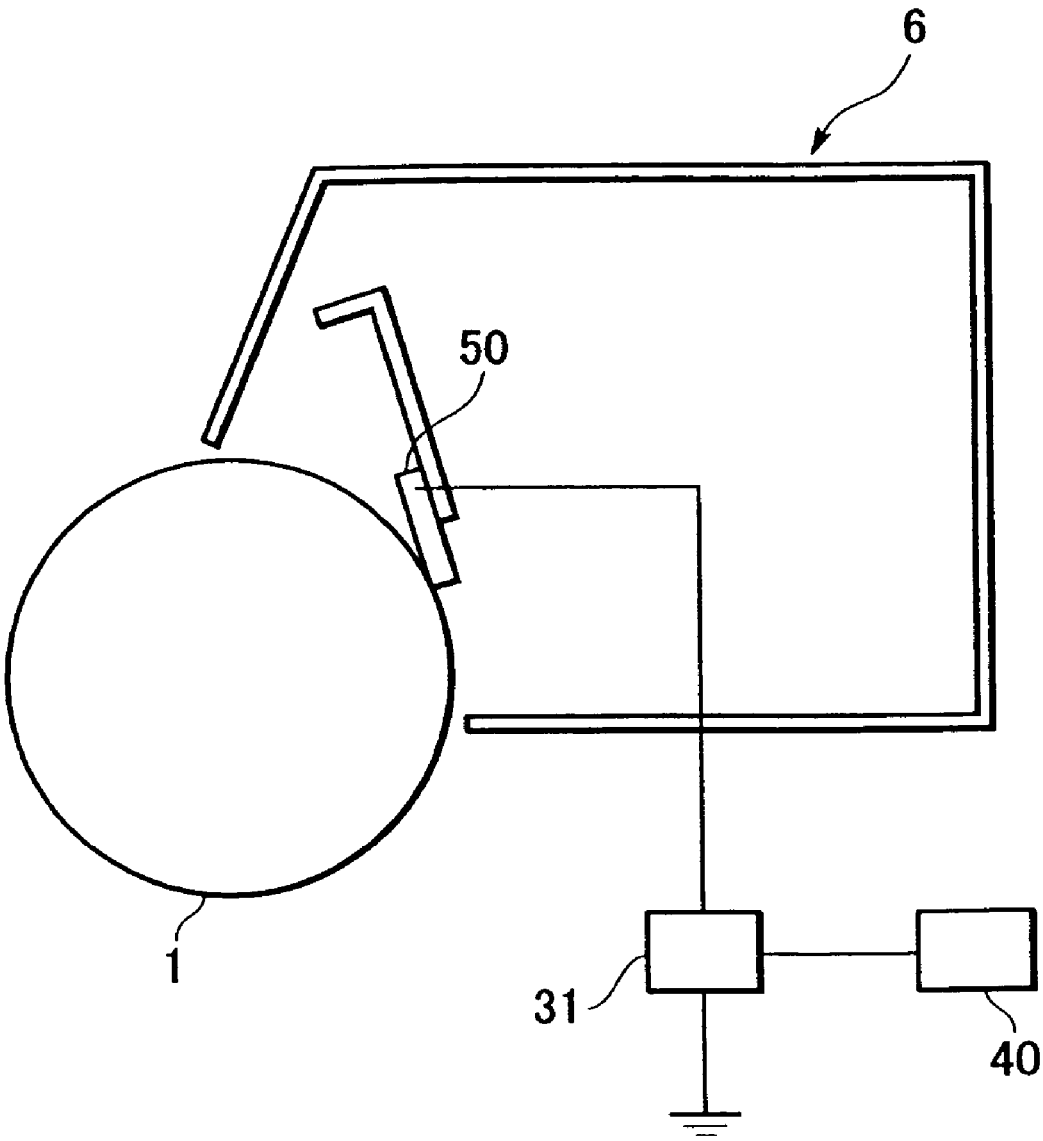
FIG. 5 is a side sectional view of a cleaning device according to another embodiment of the present invention.

FIG. 5 shows another embodiment in which the construction has been applied to a cleaning unit 6 for a photosensitive member or drum 1. According to the construction shown in the drawing, a bias is supplied from a high-voltage power source 31 controlled by a controller 40 and applied to an electroconductive cleaning blade 50 abutted against the photosensitive drum 1, which is an image bearing member.

In this embodiment, the bias can be applied to the cleaning blade 50 in, for example, the resetting operation following the occurrence of a paper jam, as in the foregoing embodiment. More specifically, the cleaning is carried out without applying any bias to the cleaning blade 50 in the normal image formation mode, while the bias is applied to the cleaning blade 50 only in the resetting operation. This makes it possible to securely remove the toner on the photosensitive drum 1 when jamming occurs.

As another alternative, if a toner pattern used primarily for detecting density is formed on the photosensitive drum 1, then a bias may be applied to a cleaning blade 50 when the toner pattern is withdrawn. More specifically, cleaning is carried out without applying any bias to the cleaning blade 50 in the normal image formation mode, while the bias is applied to the cleaning blade 50 only when the toner pattern is formed as detected by. With this arrangement, a toner pattern carrying a larger quantity of toner can be securely removed.

In the foregoing embodiment, the descriptions have been given of the cleaning unit 6 for the photosensitive drum 1 in which images are transferred to an intermediate transferrer. The present invention, however, can be applied also to a photosensitive drum adapted to directly transfer images onto a transfer material, such as paper.

Figure 6:
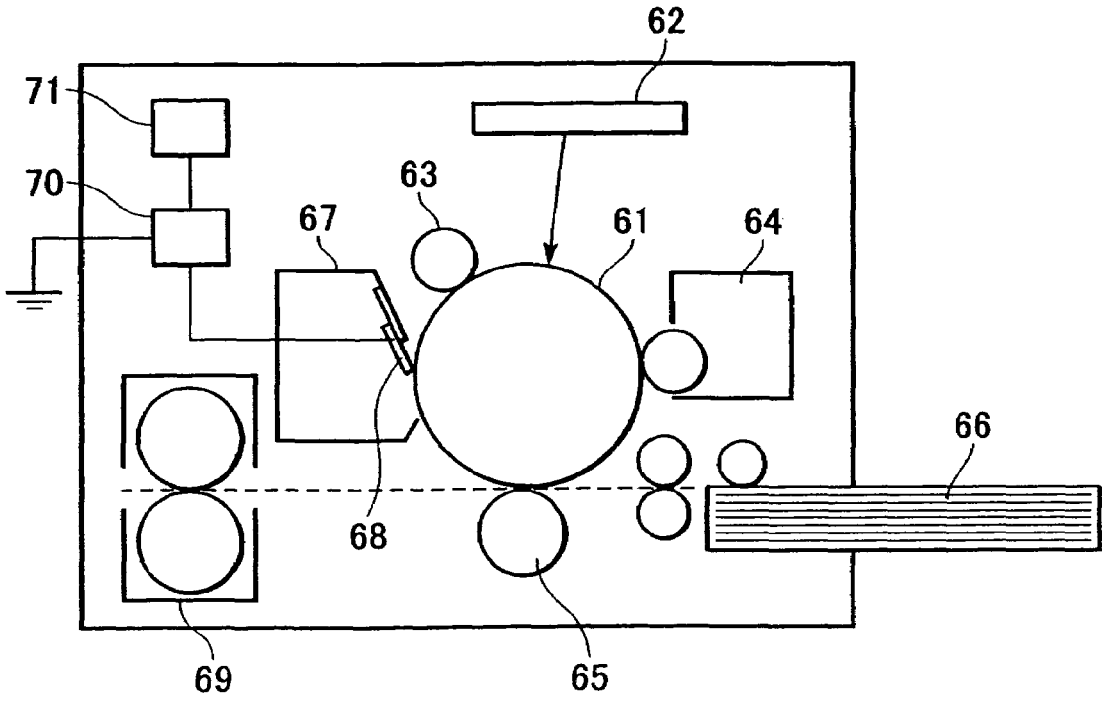
FIG. 6 is a side sectional view of an image forming apparatus according to another embodiment.

FIG. 6 shows an image forming apparatus according to another embodiment to which the aforesaid construction has been applied. A photosensitive drum 61, which is an image bearing member (a first image bearing member), is uniformly charged by a primary charging roller 63, then a latest image is formed by exposure by an exposure unit 62. Subsequently, the latest image is developed with a developer by a developing unit 64. The image developed with the developer is transferred onto a transfer material (a second image bearing member) fed from a cassette 66 by a transfer roller 65, which is a transfer unit, to which a bias is applied, then the transferred image is fixed by a fixing unit 69. The developer left over from the transfer on the photosensitive drum 61 is removed by a cleaning blade 68 of a cleaning unit 67. The cleaning blade 68 has the same construction as that explained in the foregoing embodiment. The bias supplied from a power source 70 is applied, or electric charges are supplied, to the cleaning blade 68. The power source 70 is controlled by a controller 71.

The timings at which the bias is applied to the cleaning blade 68 in this embodiment may be set to the same as those described in the foregoing embodiment.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus, comprising:

image forming means for forming a developer image on a first image bearing member;

transferring means for transferring the developer image on said first image bearing member onto a second image bearing member;

a cleaning member for cleaning said first image bearing member;

changing means for changing an abutting pressure of said cleaning member against said first image bearing member; and controlling means for controlling said changing means based on a formation of a developer image formed for detection such that an abutting pressure used while said developer image formed for detection on said first image bearing member is removed is higher than an abutting pressure used while a developer remaining on said first image bearing member is removed after the developer image is transferred onto said second image bearing member.

2. An image forming apparatus, comprising:

image forming means for forming a developer image on a first image bearing member;

transferring means for transferring the developer image on said first image bearing member onto a second image bearing member;

a cleaning member for cleaning said first image bearing member;

changing means for changing an abutting pressure of said cleaning member against said first image bearing member; and controlling means for controlling said changing means based on a stoppage of image forming operation caused by a functional problem during the image formation operation such that an abutting pressure used while a developer remaining on said first image bearing member that is not transferred onto said second image bearing member is removed is higher than an abutting pressure used while a developer remaining on said first image bearing member is removed after the developer image is transferred onto said second image bearing member.

* * * * *